US006447157B1

(12) United States Patent
Running et al.

(10) Patent No.: US 6,447,157 B1
(45) Date of Patent: Sep. 10, 2002

(54) TRANSPORTATION OF SOLUBLE SOLIDS

(75) Inventors: Robert Elmer Running, Wrightsville Beach; Richard Anderson McBraye, Wilmington; Gregory Nash Latham, Currie; Riley F. West, Jr., Wilmington, all of NC (US)

(73) Assignee: Occidental Chemical Corporation, Dallas, TX (US)

( * ) Notice: Subject to any disclaimer, the term of this patent is extended or adjusted under 35 U.S.C. 154(b) by 52 days.

(21) Appl. No.: 09/660,128

(22) Filed: Sep. 12, 2000

Related U.S. Application Data

(62) Division of application No. 09/435,906, filed on Nov. 8, 1999.

(51) Int. Cl.[7] ..... B01F 7/06

(52) U.S. Cl. ..... 366/251; 366/270; 366/307; 105/358

(58) Field of Search ..... 366/281–285, 366/307, 270; 406/135; 105/358, 360

(56) References Cited

U.S. PATENT DOCUMENTS 130,536 A * 8/1872 Rosen
1,652,960 A * 12/1927 Snelling et al.
1,693,170 A * 11/1928 Alsop
2,139,430 A * 12/1938 Witham, Jr.
2,376,722 A * 5/1945 Podelll
2,791,406 A * 5/1957 Bates
2,854,202 A * 9/1958 Blume, Jr. et al.
2,965,364 A * 12/1960 Parker et al.
3,068,186 A * 12/1962 Paulus et al.
4,390,286 A * 6/1983 Regaldo
5,282,681 A * 2/1994 Superlak
5,366,289 A * 11/1994 Superlak
5,746,890 A * 5/1998 Forslund
6,276,825 B2 * 8/2001 Running et al.
6,276,826 B1 * 8/2001 Rumph

* cited by examiner

*Primary Examiner*—Charles E. Cooley
*Assistant Examiner*—David Sorkin
(74) *Attorney, Agent, or Firm*—Richard D. Fuerle

(57) ABSTRACT

Disclosed is an agitator assembly which comprises an agitator and means for mounting the agitator assembly on top of a tank. The agitator comprises a shaft, a propeller fixed to one end of the shaft, and means for rotating the shaft to provide an axial discharge from the propeller of at least 4.0 m/sec with a flow equivalent of at least 0.2 tank volumes/minute. The agitator is mounted on top of the tank so that the shaft enters the tank at an angle a to the longitudinal axis of the tank of between about 30 and about 60 degrees and at an angle β to the transverse vertical axis of the tank of less than about 50 degrees.

Also disclosed is a method of shipping solids that are soluble in a solvent. The solids are placed in a tank on which the agitator assembly has been mounted. The quantity of solids placed in the tank exceeds the amount that will dissolve when the tank is filled with the solvent. The tank is transported to the location where the solids are to be removed from the tank. Solvent is added to the tank around the propeller, the propeller is rotated, and the resulting solution is removed from the tank. Solvent is repeatedly added and the resulting solution removed.

20 Claims, 3 Drawing Sheets

TRANSPORTATION OF SOLUBLE SOLIDS

This application is a division of application Ser. No. 09/435,906, filed Nov. 8, 1999, pending.

BACKGROUND OF THE INVENTION

This invention relates to an apparatus for and method of transporting soluble solids in a tank. In particular, it relates to an agitator that is mounted on the top of a horizontal cylindrical railroad tank car and has a shaft that penetrates into the car at certain angles and rotates a propeller so as to cause fluid within the tank to move in a helical pattern around the tank.

Soluble solids, such as chromic acid, are shipped in lined steel rail cars. These solids are removed from the cars by dissolving all the solids in the car in a solvent, usually water, then removing the resulting solution from the car. Since most solids can not be dissolved in a reasonable time without at least a temporary increase of total system volume (volume of solvent+volume of solids+volume of solution), the cars can be filled with only that quantity of solids that will dissolve when the car is filled to the maximum allowable level with solvent, which is usually far less than the dry weight capacity of the car.

Many hours may be required to dissolve all of the contents of a railroad car, which can be about 6 to about 18 m long, about 2.4 to about 3.0 m in diameter, and can hold about 37,850 to about 94,625 L (about 10,000 to about 25,000 gallons). Agitators are used to reduce the time needed to dissolve the solids. These agitators are often mounted inside the car and direct a thrust either radially away from the agitator shaft or vertically downward. Because the length of a railroad car can be over three times its diameter, a single agitator can reach only a portion of the solids in the car and as many as 5 agitators are sometimes needed to dissolve all of the solids.

Agitation can also be accomplished by sparging air through the solvent/solids/solution mixture in the car. This procedure is also time-consuming, can result in airborne emissions, and is able to generate solutions approaching only 80 to 90% of saturation within a reasonable length of time.

SUMMARY OF THE INVENTION

In our invention, the agitator is mounted on top of the tank. Its shaft enters the tank at particular angles relative to the tank's longitudinal and vertical axes and turns a propeller. We have discovered that if the shaft is within the angles specified and the flow generated by the propeller is within the proper direction, velocity, and volume, a single agitator will move the fluid within the tank in a highly structured helix or spiral flow pattern and the entire contents will be agitated and dissolved. Because the agitator of this invention is much more effective than prior agitators and air sparging, the time required to dissolve all of the contents of the car is reduced by as much as 2400%.

A major advantage of the agitator of this invention is that it enables a shipper to transport a much greater quantity of solids in the tank. While in the prior process the maximum amount of shipable solids was the amount that would dissolve when the tank containing solids was filled with solvent such that the total mixture of solids/solvent/solution reached the maximum volume that the tank could safely contain without overflowing, in our invention nearly the entire tank can be filled with solids. This is possible because, after initially filling the car with solvent, a brief agitation period, and removal of a portion of the solution, more solvent can be added continuously or in batches near the agitator and drainage point so that the resulting solution(s) can be removed without entraining undissolved solids. The volume of solids dissolved gradually expands from the space between the propeller and the drain until the entire contents of the tank have been dissolved and removed.

DESCRIPTION OF THE PREFERRED EMBODIMENTS

Figure 1:
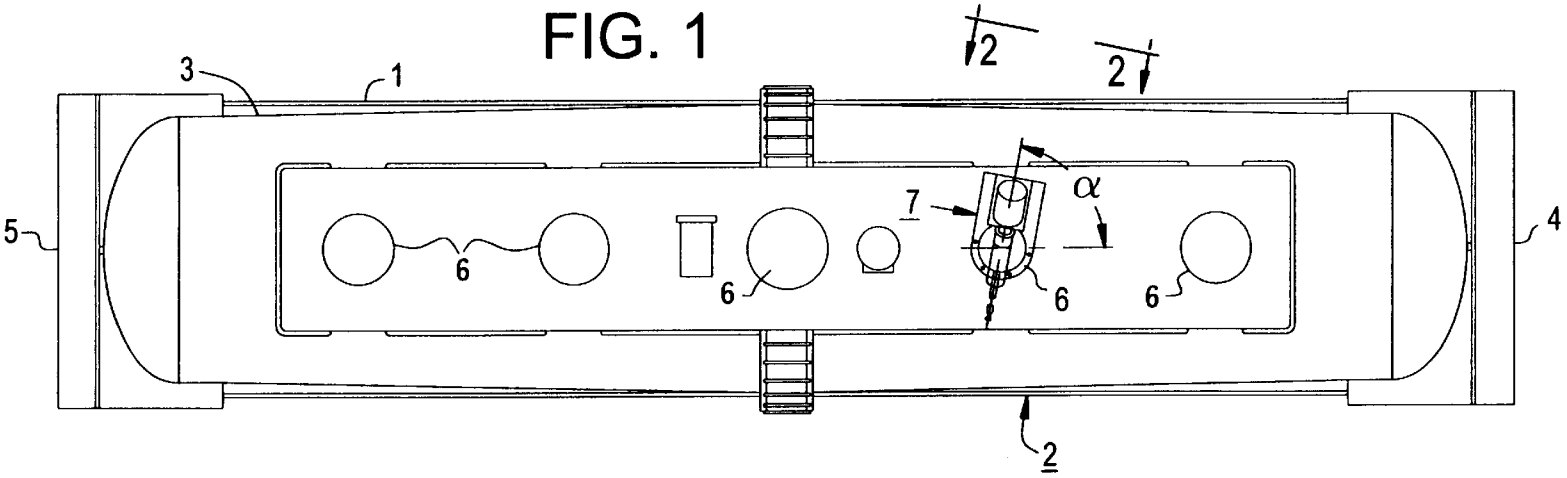
FIG. 1 is a top view of a rail car agitator according to this invention mounted on top of a railroad tank car.

In the drawings, especially FIG. 1, a horizontal cylindrical steel insulation jacket 1 of a railroad tank car 2 surrounds working tank 3. Working tank 3 has a front end 4, a rear end 5, and multiple nozzles 6 on top. Over the second nozzle 6 from front end 4 is mounted agitator 7 according to this invention. (Additional agitators can be mounted over other nozzles if desired.)

Figure 3:
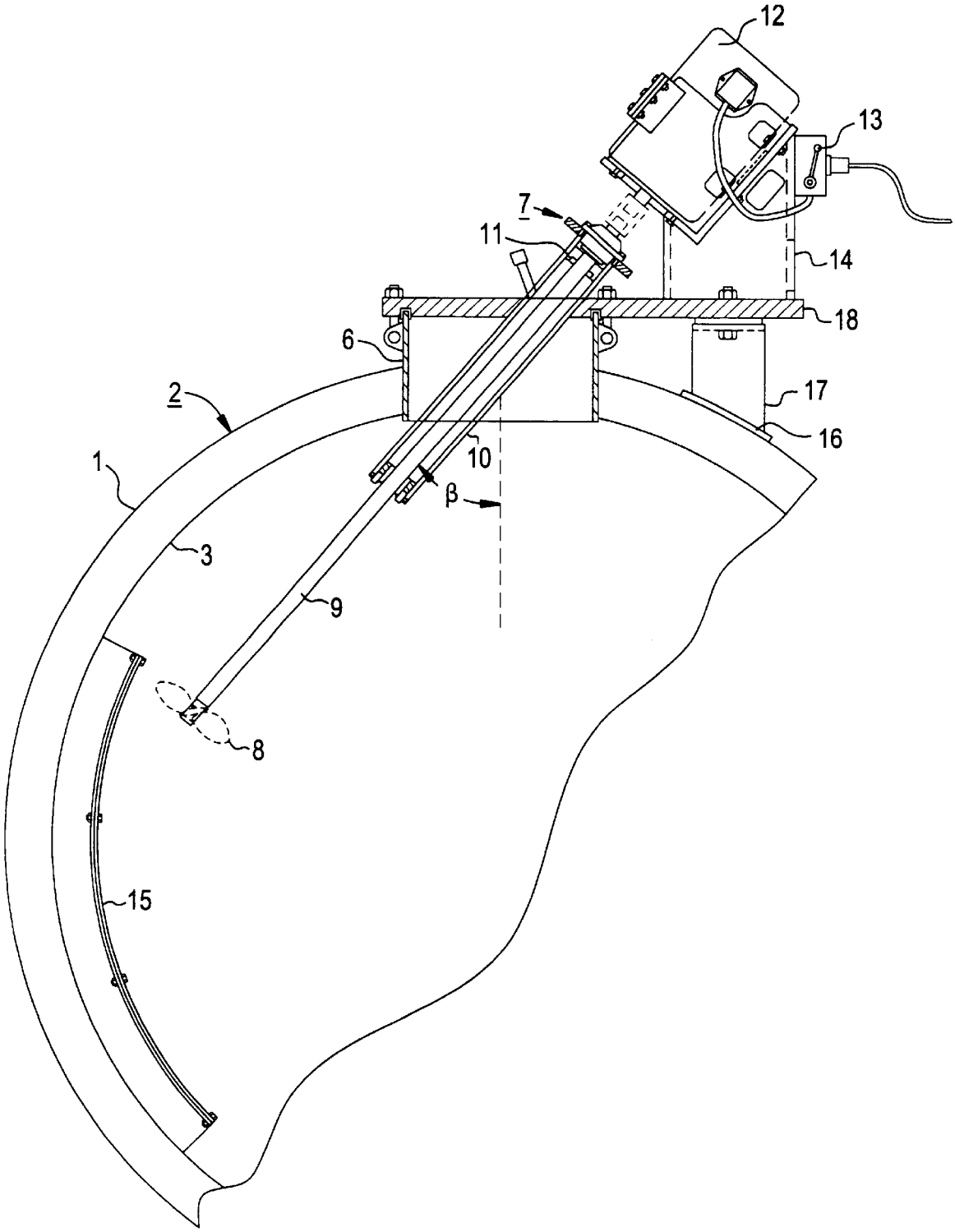
FIG. 3 is a cross-sectional side view through the railroad tank car shown in FIG. 1, viewed from end 4.

In FIG. 3, propeller 8 is fixed to shaft 9 which passes through support housing 10. Mechanical seal 11 seals shaft 9 in a leakproof fashion to permit car 2 to travel as a regulated pressure vessel capable of withstanding 1135 kilopascals (150 psig), although the car's contents are dry and unpressurized during travel. An electric motor 12 controlled by switch 13, can rotate shaft 9. Mounting brackets 14 are sized and positioned such that shaft 9 can be adjusted to a variety of angles $\alpha$ (FIG. 1) to the longitudinal axis of tank 3. Shaft 9 is fixed at an angle $\beta$ (FIG. 3) to the transverse vertical axis of tank 3; angle $\beta$ can be made adjustable, if desired. The angle $\alpha$ is between about 30 and about 60 degrees (or it is about 90 degrees) and the angle $\beta$ is less than 50 degrees to insure that the axial discharge from propeller 8 impinges against the wall of tank 3 at an angle such that the fluid momentum is conserved and the fluid follows the curvature of the wall of tank 3 in a helical flow pattern. Larger and smaller angles are less effective in dissolving the contents of the car; preferably, the angle $\alpha$ is between about 35 and about 45 degrees and the angle $\beta$ is between about 35 and about 45 degrees.

Agitator 7 can be mounted over any of the nozzles 6 but, if agitator 7 is mounted over the center nozzle, angle $\alpha$ is preferably about 90 degrees and an impingement plate 15 is attached to the inside of tank 3 in the path of the moving fluid. The shape of impingement plate 15 can be adjusted to direct the thrust towards the ends 4 and 5 of tank 3, especially when agitator 7 is in the center nozzle. Impingement plate 15 also lessens the rate of corrosion and erosion of tank 3. Agitator 7 is preferably mounted near an end 4 or 5 of tank 3, however, so that propeller 8 is about 0.1 to about 0.35 times the total tank horizontal length of car 2 from the end closest to agitator 7. This position provides efficient mixing and leaves the center nozzle 6 uncluttered so that personnel movement onto and off the rail car is not hampered, as access stairs and handrail openings are typically in the center position. Propeller 8 is also preferably about 0.2 to about 0.4 m away from the sides of tank 3 (or from impingement plate 15, if one is used), assuming a tank having a diameter greater than about 2 m, as that position is also more effective. Propeller 8 should be submerged in the fluids in tank 3 to a level of at least 3 times the diameter of the propeller 8 to avoid entraining air through cavitation, because cavitation significantly reduces agitation efficiency.

Figure 2:
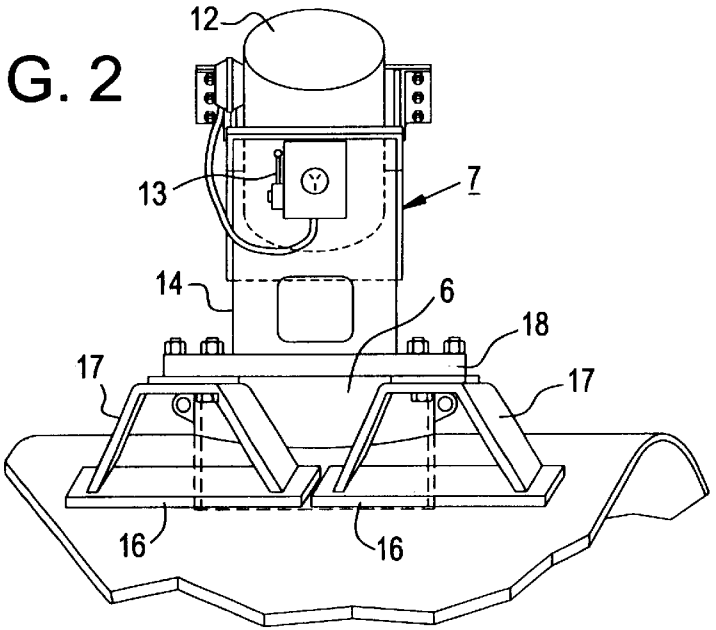
FIG. 2 is a side view through 2—2 in FIG. 1.

In FIGS. 2 and 3, baseplates 16 are welded to insulation jacket 1 and to flange supports 17. A heavy agitator support plate 18 is bolted to flange supports 17 and motor mounting brackets 14 are welded to support plate 18.

In order to agitate the entire contents of the tank using only a single agitator, agitator 7 should have a discharge velocity of at least about 4.0 m/sec and a flow equivalent of at least 0.2 tank volumes/minute as less velocity and flow may not produce the desired flow geometry and will therefore require much longer dissolution times; a velocity greater than 6 m/sec and a flow greater than 0.4 tank volumes/minute are usually unnecessary. A velocity of about 4.25 to about 4.75 m/sec and a flow of about 0.22 to about 0.26 tank volumes/minute are preferred. If a solvent other than water is used and its viscosity differs from the viscosity of water such that the mixture viscosity is altered from the mixture's viscosity when using water, the velocities and flows should nevertheless be maintained at the values stated. Power demand will vary in a direct relationship to the ratio of mixture viscosities.

Once the agitator has been mounted on the tank it need not be removed, except for servicing. The tank is filled with soluble solids, such as chromic acid. The solids are preferably placed so they will not come into contact with the propeller as that would impede the propeller's rotation, though this is not absolutely necessary as the later addition of the solvent can wash the solids away from the propeller.

Figure 4:
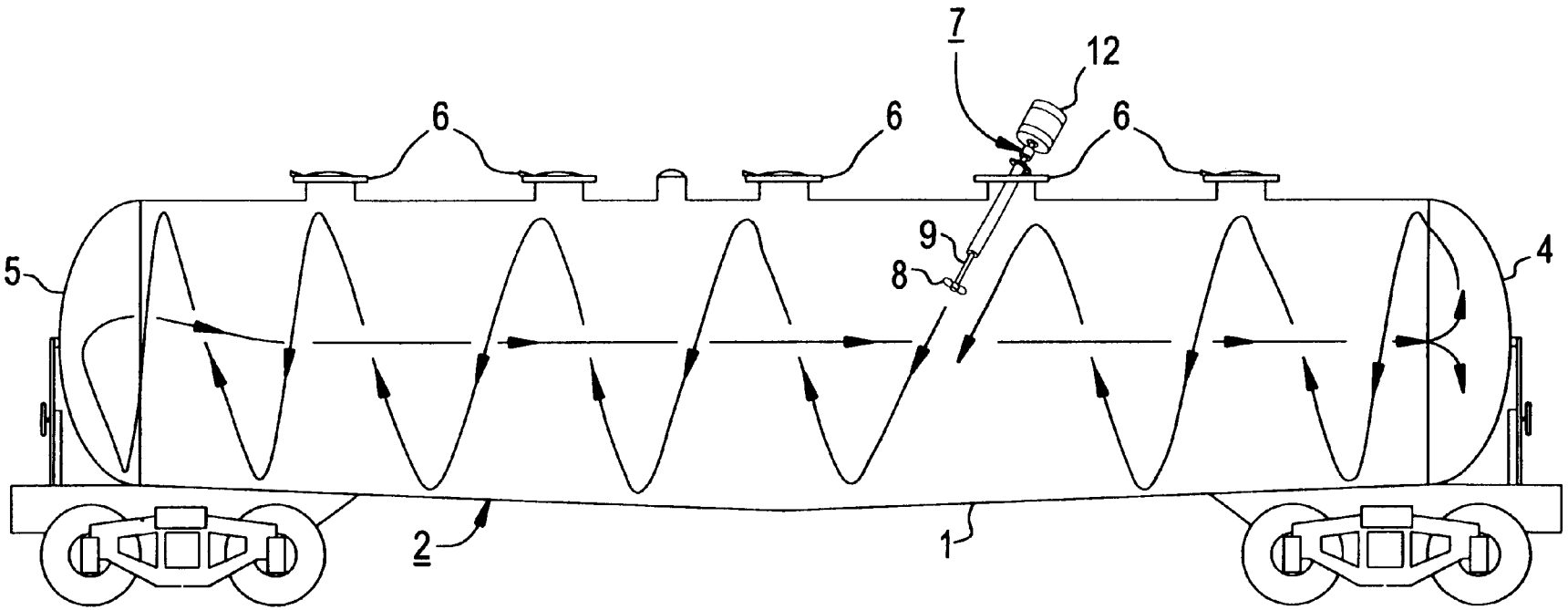
FIG. 4 is an exposed side view of the railroad tank car shown in FIG. 1, showing the flow pattern that results from using this invention.

When the tank holding the solventless solids reaches its destination, a solvent in which the solids are soluble is admitted to the tank around the propeller The tank should be filled with solvent to a level higher than 80% of the tank's diameter in order to maintain fluid momentum and allow major currents within the tank to spiral about the horizontal transverse axis of the tank as shown in FIG. 4. The agitator is turned on. If the quantity of solids placed in the tank is less than the quantity that can be dissolved in this quantity of solvent, agitation can be continued until all of the soluble solids in the car have been dissolved. The resulting solution can then be pumped out of the tank or permitted to flow out of the bottom of the tank.

Preferably, however, the quantity of solids placed in the tank exceeds the quantity that will dissolve when the tank is filled with the solvent. In this case, the solids can be removed either in a continuous process or a batch process. In the continuous process, solvent is continuously added around the propeller, dissolving a portion of the solids, and the resulting solution is continuously removed until all of the solids have been removed. In a batch process, enough solvent is added to the solids to bring the total volume of the mixture of solids/solvent/solution to the maximum allowable for the tank. The agitator is activated and the solids that are near the propeller or downstream from it dissolve first. The agitator is turned off and the drain is opened to remove the solution, which can be, for example, between about 20 and about 30% of the tank's volume. More solvent is added to replace the removed solution and maintain the fluid level at at least 80% of the tank's diameter. The agitator is turned on again and the process is repeated until the tank is empty. The batch process is preferred because the continuous method is less efficient when the solution is at or near saturation.

The agitator of this invention can be used on the tanks of trains, trucks, boats, and other equipment. While the tank is preferably cylindrical, the agitator can also be used with tanks of other cross-sectional shapes.

The following example further illustrates this invention:

EXAMPLE 1

A railcar with a capacity of 51,165 liters (13,500 gallons) can be loaded with 39.47 metric tonnes (43.5 short tons) of dry chromic acid flake ($CrO_3$) and delivered to a customer. The customer can add 32,367 liters (8,540 gallons) of water to the car and air agitate the mixture until all of the chromic acid has dissolved, producing 45,480 liters (12,000 gallons) of a 55% chromic acid solution. (The 5,685 liter or 1,500 gallon "freeboard" is a safety margin to insure that the car does not overflow.)

If the same railcar, fitted with an agitator assembly according to this invention, is loaded with 58.98 metric tonnes (65 short tons) of dry chromic acid flake (bulk density ~1.402 kg/liter or 87.5 lb/ft$^3$), less than 43,585 liters (11,500 gallons) of the total volume of the car will be occupied. At the customer's site, approximately 24,256 liters (6400 gallons) of water can be added to the car and mixed with the $CrO_3$, dissolving 29.67 metric tonnes (32.7 short tons) of the $CrO_3$ and producing approximately 34,110 liters (9,000 gallons) of a 55% solution of $CrO_3$. With a specific gravity of 2.70, the undissolved $CrO_3$ will occupy approximately 10,877 liters (2,870 gallons) of the car's total volume. At this point, the solution and the undissolved $CrO_3$ occupy about 44,987 liters (11,870 gallons) of the car's total volume.

Approximately 22,740 liters (6,000 gallons) of the 55% solution, containing about 19.78 metric tonnes (21.8 short tons) of $CrO_3$, can be pumped and/or drained from the car, then approximately 23,877 liters (6300 gallons) of water added. The agitator assembly can then dissolve the remaining 39.2 metric tonnes (43.2 short tons), forming a 55% solution that occupies about 45,840 liters (12,000 gallons) of the car's volume. This solution can also be drained and/or pumped from the car.

Thus, by utilizing the agitator assembly of this invention, an additional 19.5 metric tonnes (21.5 short tons) of chromic acid can be delivered in the same railcar.

EXAMPLE 2

An agitator according to this invention was fitted to the top of a cylindrical rail car, 4.1 m from the end of the car. The car was 12 m long and 2.5 m in diameter, and had 5 viewing ports in its top. The angle $\alpha$ was 350 and the angle $\beta$ was 40°. The propeller was 0.2 m from the inside wall of the car. The agitator had a discharge velocity of 4.25 m/sec and a flow equivalent of 0.22 tank volumes/minute. The tank was filled to 80% of its diameter with water containing 1 ppm pearl beads that were 2 mm in diameter and had a density of about 1 g/cc. Within 3 minutes after the agitator was turned on, the pearls could be observed moving in the helical pattern shown in FIG. 4. A small flag mounted on the end of a long shaft was lowered into the flowing water at various positions; the direction of the flag confirmed the flow pattern shown in FIG. 4.

We claim:

1. Apparatus comprising (A) a cylindrical tank having a horizontal longitudinal axis, an intersecting vertical axis, and at least one nozzle on top that can be opened to provide access to the inside of said tank;

(B) an agitator which comprises
(1) a shaft;
(2) a propeller fixed to one end of said shaft; and
(3) means outside said tank for rotating said shaft;

(C) means outside said tank for mounting said agitator on top of said tank over said nozzle so that said end of said shaft enters said tank through said open nozzle at an angle $\alpha$ to said longitudinal axis and at an angle $\beta$ to said vertical axis, where $\beta$ is about 35 to about 50 degrees, and where
(i) said agitator is mounted near the center of said tank and a is about 90 degrees; or
(ii) said agitator is not mounted near the center of said tank and a is about 35 to about 60 degrees; and (D) means for sealing said nozzle around said shaft, whereby liquid in said tank cannot leave said tank through said nozzle.

2. Apparatus according to claim 1 wherein $\alpha$ is between about 35 and about 45 degrees.

3. Apparatus according to claim 1 wherein $\beta$ is between about 35 and about 45 degrees.

4. Apparatus according to claim 1 wherein said agitator is mounted so that said propeller will be submerged to a depth of at least about 3 times the diameter of said propeller when said tank is filled with solvent.

5. Apparatus according to claim 1 wherein said shaft is rotated by means of an electric motor.

6. Apparatus according to claim 1 wherein said means for mounting said agitator permits the adjustment of angles $\alpha$ and $\beta$.

7. Apparatus according to claim 1 mounted on a railroad car.

8. Apparatus according to claim 1 mounted on a truck.

9. Apparatus according to claim 1 wherein said means for mounting is welded to said tank.

10. Apparatus according to claim 1 wherein the inside of said tank is provided with an impingement plate attached over the inside of said tank in the path of flow from said propeller.

11. Apparatus according to claim 1 wherein said tank is about 6 to about 18 m long and about 2.4 to about 3.0 m in diameter.

12. Apparatus according to claim 1 wherein said propeller is about 0.2 to about 0.4 m from the side of said tank and about 0.1 to about 0.35 times the total tank horizontal length from the end closest to said agitator.

13. Apparatus according to claim 1 wherein said means can rotate said shaft with a discharge velocity of at least 4.0 m/sec and a flow equivalent of at least 0.2 tank volumes/minute.

14. Apparatus according to claim 1, wherein said agitator is mounted near the center of said tank.

15. Apparatus according to claim 14 wherein said angle $\alpha$ is about 90° and said tank has an impingement plate mounted on its inside in the path of said discharge, said impingement plate being shaped to direct said discharge to the ends of said tank.

16. Apparatus according to claim 1, wherein said tank is not mounted near the center of said tank.

17. Apparatus according to claim 1 wherein said tank has a capacity of about 10,000 to about 25,000 gallons.

18. Apparatus according to claim 1 wherein said shaft passes into said tank through a leakproof seal capable of withstanding a pressure of 150 psig.

19. A railroad car having mounted thereon apparatus comprising (A) a cylindrical tank having a horizontal longitudinal axis, an intersecting vertical axis, and at least one nozzle on top that can be opened to provide access to the inside of said tank;

(B) an agitator that comprises
(1) a shaft one end of which enters said tank through a nozzle;
(2) a propeller inside said tank and fixed to said end of said shaft;
(3) means outside said tank for rotating said shaft so that said propeller has an axial discharge velocity of flow of about 4.25 to about 4.75 m/sec with a flow equivalent of about 0.22 to about 0.26 tank volumes/minute, where said shaft is at an angle $\alpha$ to said longitudinal axis of between about 35 and about 45 degrees when said agitator is not near the center of said tank and at about 90 degrees when said agitator is near the center of said tank, and at an angle $\beta$ to said vertical axis of between about 35 and about 45 degrees; and
(4) means welded to the outside of said tank for mounting said agitator on the top of said tank, where (C) means for sealing said nozzle around said shaft, whereby liquid in said tank cannot leave said tank through said nozzle.

20. A railroad car having mounted thereon apparatus comprising (A) a cylindrical tank having a horizontal longitudinal axis, an intersecting vertical axis, and multiple nozzles on top;

(B) an agitator assembly mounted over a nozzle that is not in the center of said tank, where said agitator assembly comprises
(1) an agitator which comprises
(i) a shaft;
(ii) a propeller fixed to one end of said shaft; and
(iii) an electric motor capable of rotating said shaft in fluid in said tank with a flow discharging axially from said propeller of about 4.25 to about 4.75 m/sec with a flow equivalent of about 0.22 to about 0.26 tank volumes/minute; and
(2) means welded to the top of said tank for mounting said agitator over said nozzle so that
(i) said shaft enters said tank through said nozzle at an adjustable angle $\alpha$ to the longitudinal horizontal axis of said tank of between about 35 and about 45 degrees when said agitator is not near the center of said tank and at about 90 degrees when said agitator is near the center of said tank, and at an adjustable angle $\beta$ to the vertical axis of said tank of between about 35 and about 45 degrees; and
(ii) said propeller is about 0.2 to about 0.4 m from a side of said tank; and.
(3) means sealing said agitator to said nozzle capable of withstanding a pressure of 150 psig.

* * * * *